United States Patent [19]

Drapac

[11] 3,988,705

[45] Oct. 26, 1976

[54] BALANCED FOUR-WAY POWER DIVIDER EMPLOYING 3DB, 90° COUPLERS

[75] Inventor: Michael J. Drapac, Cedar Rapids, Iowa

[73] Assignee: Rockwell International Corporation, El Segundo, Calif.

[22] Filed: Nov. 20, 1975

[21] Appl. No.: 633,774

[52] U.S. Cl. ..... 333/10; 333/24 R

[51] Int. Cl.[2] ..... H01P 5/18

[58] Field of Search ..... 333/6, 10

[56] References Cited

UNITED STATES PATENTS 3,490,054 1/1970 Seidel ..... 333/10

3,748,601 7/1973 Seidel ..... 333/10

*Primary Examiner*—Paul L. Gensler

*Attorney, Agent, or Firm*—Robert J. Crawford; Howard R. Greenberg

[57] ABSTRACT

A triple 3db, 90° coupler four-way power divider provides four balanced power outputs by combining therewith a fourth coupler, each of whose two inputs is connected to a different one of the two unbalanced outputs of the divider, with the two outputs of the fourth coupler and the two balanced outputs of the divider providing the four-way divided output power.

3 Claims, 2 Drawing Figures

BALANCED FOUR-WAY POWER DIVIDER EMPLOYING 3DB, 90° COUPLERS

BACKGROUND OF THE INVENTION

The present invention pertains generally to electrical power dividers and specifically to a four-way power divider which employs 3db, 90° couplers.

In electronics, quite often the processing of an electrical signal cannot be performed until the signal is first divided into two or more components. For example, in VHF-UHF applications a signal which might be in the order of 100 watts could require amplification to a much higher power level such as 400 watts prior to radio transmission. If a solid-state amplifier were to be used, as is now commonplace, then a single commercial transistor could not handle the amplification by itself since its rated capacity, which might typically be as high as 100 watts is much less than the total power imparted to the signal during amplification. This problem is obviated by the use of power dividers which divide the signal into smaller power components which can be individually handled by individual transistors during the signal processing and recombined into a single signal thereafter. In the foregoing example, a four-way power divider would be necessary in order to allow each 100 watt transistor of a four-transistor amplifier to amplify the signal after first dividing it into four power components. After amplification, the four signals would of course be recombined into one 400 watt signal.

A well-known element used in power dividers is the 3db, 90° coupler (sometimes referred to as a quadrature hybrid coupler) which is discussed in a number of references including Chapter 13, entitled "TEM-Mode, Coupled-Transmission-Line Directional Couplers, and Branch-Line Directional Couplers" of a book whose title is "Microwave Filters, Impedance-Matching Networks And Coupling Structures" by Matthaei, Young and Jones and an article "Don't Overspecify With Quad Hybrids" which appeared in two parts in the January and February, 1973, editions of Microwaves magazine. The 3db, 90° coupler (coupler for short hereinafter) has two input ports and two output ports. With one input connected to a terminating impedance matched to the system characteristic impedance, a signal at the other input produces signals at the two outputs of the coupler each of which contains approximately one-half of the power engendered by the input signal (neglecting insertion loss) and differ in phase from each other by about 90°. Because of the intrinsic design of the coupler, one output, conventionally referred to as the 0° output (phase measured with respect to that of the input signal), contains more than one-half of the input signal power by a given amount and the other output, conventionally referred to as the −90° output (phase likewise measured with respect to that of the input signal), contains less than one-half of the input signal power by the same aforementioned given amount over the operating frequency range of the coupler. If the output power at each port is normalized to the input power and measured in decibels (db), then this imbalance variation from a balanced condition, wherein both ports equally reflect one-half of the input power of −3db, typically extends to ±0.5db over the operating range so that the maximum output imbalance at the 0° port is −2.5db and that at the −90° port is −3.5db.

When one coupler is used to drive two other couplers in a triple coupler, four-way power divider, the imbalance deviation is doubled to + 1db. In this arrangement, two of the four power divider outputs are balanced at −6db (one quarter of the input signal power) over the operating frequency range, but the other two outputs are unbalanced with the 0° output exhibiting −5db and the −90° output exhibiting −7db. Since economical design considerations dictate that like functions in an electrical device such as a power amplifier be performed with like components, a consequence of the foregoing imbalance is that the full capacity of a four transistor amplifier can never be realized. Minus 5db at the 0° output of the four-way divider corresponds to about 32% of the input signal power (as opposed to the desired 25% for a balanced condition), so that when operating at its full capacity the other three transistors would be delivering only 68% of the input power although having a combined power rating of 95% of the input power (assuming the use of four equally rated transistors). Thus, despite the fact that the four transistor amplifier is capable of delivering 128% of the input signal power if operated in a balanced condition with each transistor carrying one-quarter of the load (32% of input power), more than 20% of its balanced rated capacity must go unutilized in order to avoid exceeding the capacity of the one transistor which would be connected to the 0° output of the power divider when operating in an unbalanced fashion.

With the foregoing in mind, it is a primary object of the present invention to provide a new and improved four-way power divider which employs 3db, 90° couplers.

It is therefore an object of the present invention to provide such a new and improved four-way divider which exhibits no output power imbalance as heretofore.

The foregoing objects as well as others and the means by which they are achieved by the present invention may be best appreciated by referring to the Detailed Description of the Invention which follows together with the appended drawings.

BRIEF DESCRIPTION OF THE INVENTION

In accordance with the invention, a triple 3db, 90° coupler, four-way power divider is combined with a fourth coupler, each of whose inputs is connected to a different one of the unbalanced outputs of the divider, with the two outputs of the fourth coupler and the two balanced outputs of the power divider providing the four-way divided output power. This results in an arrangement in which each of the four outputs reflect a power level of −6db (one-quarter of the input signal power) in contradistinction to the unmodified version in which the two balanced outputs reflect a level of −6db and the two unbalanced outputs reflect levels of −5 and −7db, respectively.

DETAILED DESCRIPTION OF THE INVENTION

Figure 1:
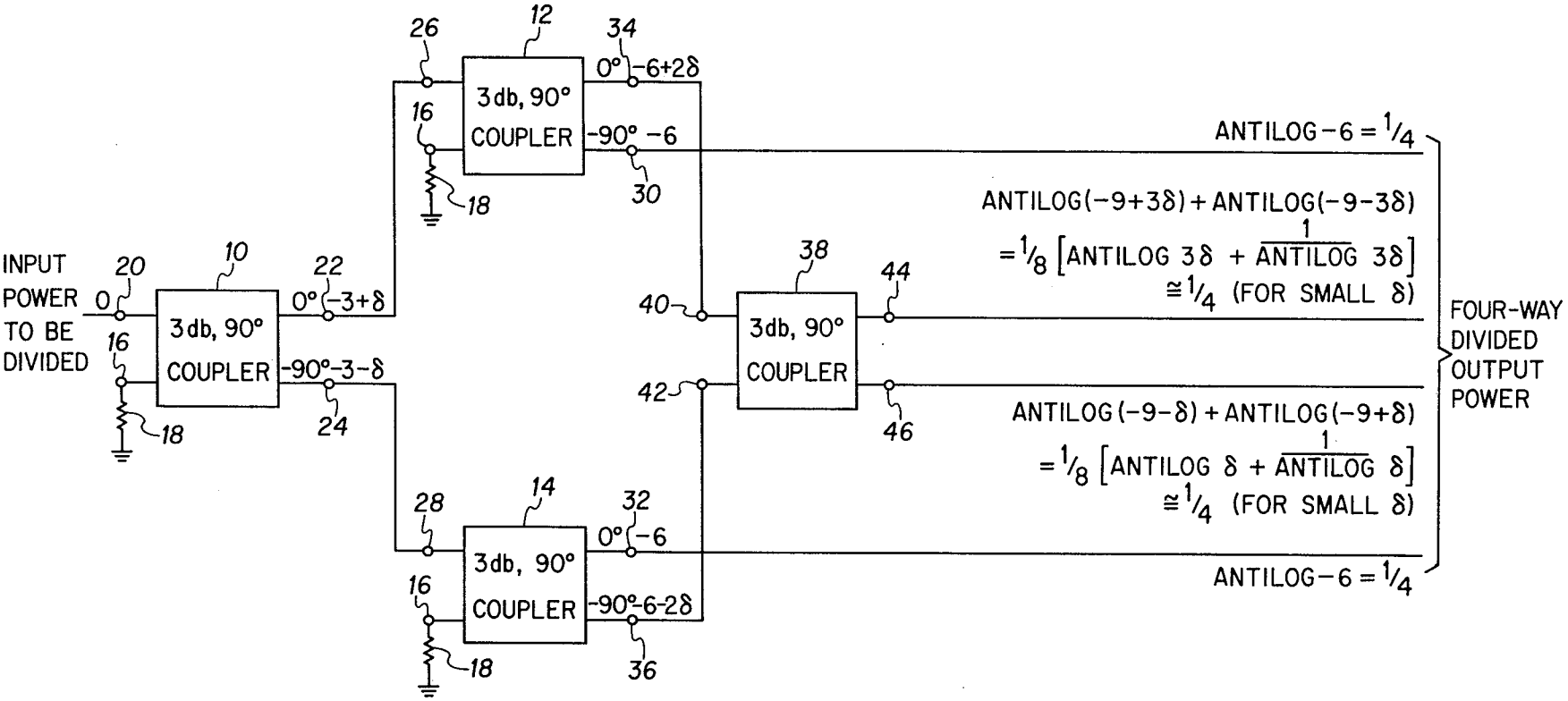
FIG. 1 depicts the triple 3db, 90° coupler four-way power divider of the prior art as modified by the invention herein.
Figure 2:
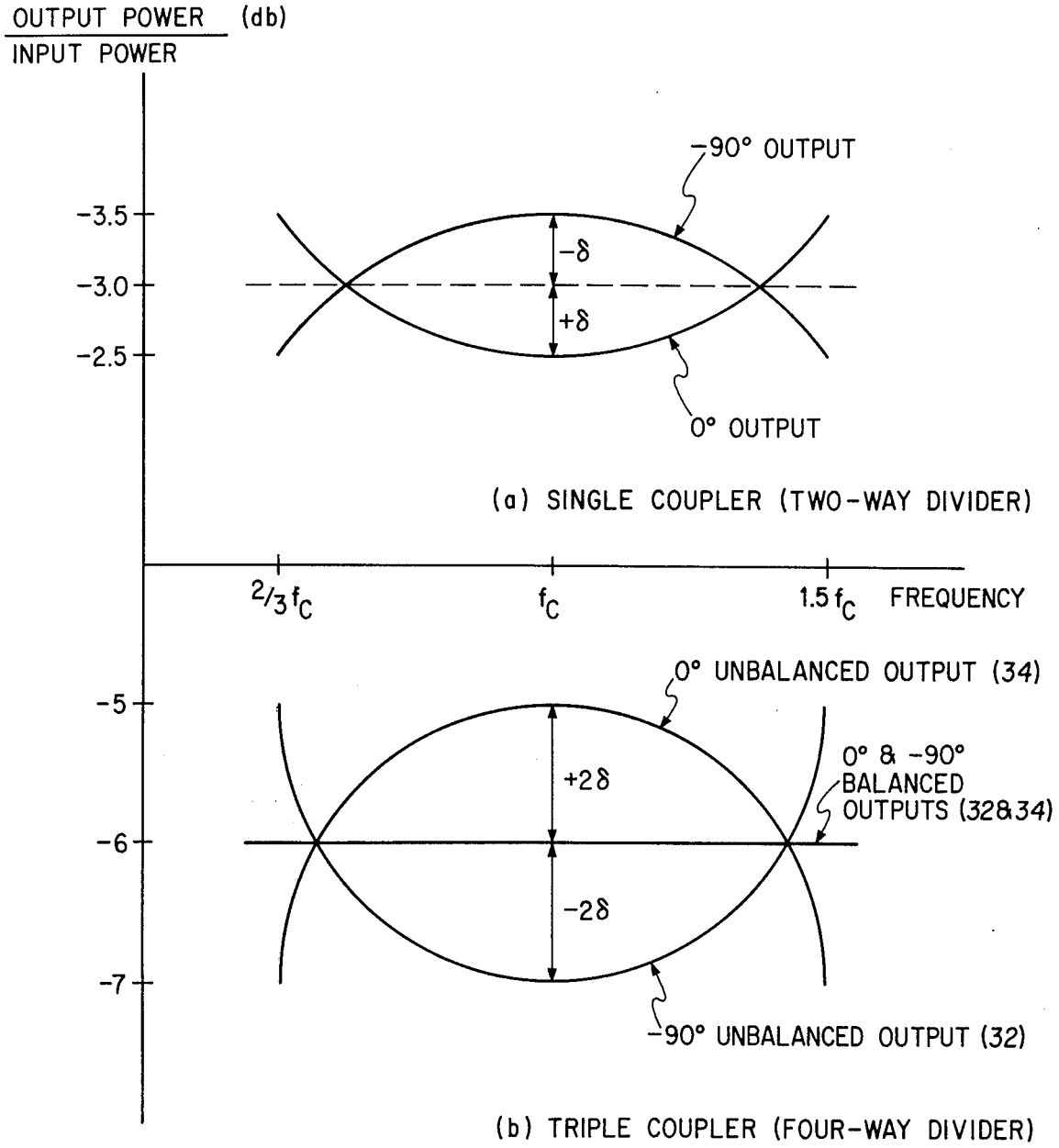
FIG. 2 graphically depicts the imbalance problems encountered in the prior art which are obviated by the invention herein.

As shown in FIG. 1, the four-way power divider of the prior art encompasses three 3db, 90° couplers, namely 10, 12 and 14, with one input 16 of each coupler connected to a terminating impedance such as resistor 18 which is matched to the characteristic impedance of the system (normally 50 ohms). The second input 20 of coupler 10 is connected to receive the signal whose power is to be divided and whose power magnitude normalized to itself is 0db represented by the 0 on the lead to input 20. In this connection, it should be mentioned that all power levels as denoted on the input and output leads to the couplers of FIG. 1 are normalized to the input power in decibels (db). As is well known to those skilled in the art, the two output signals of a 3db, 90° coupler reflect one-half of the input signal power (−3db) ±δdb (neglecting insertion loss), where δ is a function of frequency and is added at the 0° output such as 22 of coupler 10 and subtracted at the −90° output such as 24 of coupler 10. As mentioned earlier, the 0° and −90° output designations conventionally relate the phase of the output signals to that of the input signal (at the center frequency $f_c$ of the operating frequency range). As shown in FIG. 2*a*, δ varies between 0 and 0.5db (occurring at $f_c$) over an octave bandwidth of the frequency range.

The second input 26 of coupler 12 is connected to the 0° output 22 of coupler 10,while the second input 28 of coupler 14 is connected to the −90° output 24 of coupler 10. The four power outputs of the prior art four-way power divider are derived from the two outputs of couplers 12 and 14, with the −90° output 30 of coupler 12 and the 0° output 32 of coupler 14 providing balanced power levels of −6db (one-quarter of the input power) and the 0° output 34 of coupler 12 and the −90° output 36 of coupler 14 providing unbalanced power levels of (−6 +2δ)db and (−6 −2δ)db, respectively. As alluded to earlier under the Background of the Invention, this unbalanced condition precludes realizing the full capacity of a device such as an amplifier having equally matched individual components such as transistors which these outputs feed. Typical power output curves for the prior art triple coupler four-way power divider of FIG. 1 are presented in FIG. 2*b*. At the center frequency $f_c$ wherein 2δ achieves a maximum of 1db, the 0° output 34 of coupler 12 is about 32% of the input power, thereby materially impairing realizing the full capacity of the equipment into which the outputs feed.

The invention herein entails combining with the prior art triple coupler, four-way power divider a fourth coupler 38 whose inputs 40 and 42 are respectively connected to the unbalanced outputs 34 and 36 of couplers 12 and 14, respectively. The 3db, 90° coupler is a linear device so that its two outputs 44 and 46 may be determined by applying superposition to its two input signals. The output 44 power level component resulting from the signal to input 40 is (−9 +3δ)db while the component resulting from the signal to input 42 is (−9 −3δ)db. These two components can be combined by adding their antilogs as shown in FIG. 1, which results in a composite output signal 44 equal to ⅛ × (antilog 3δ +1/antilog 3δ), ⅛ being equal to the antilog of −9 and multiplying antilogs whose log values are added to one another. It will be readily seen that for δ values of about 0.5 and less, the sum of antilog 3δ and 1/antilog 3δ is always approximately 2 (for δ equal to 0.5, the sum is 2.12). Consequently, the output 44 of coupler 38 is very close to one-quarter, which is the desired balanced power level in terms of the input power.

Looking at output 46 of coupler 38, the power component resulting from the signal to input 42 has a power level of (−9 −δ)db, while the component due to the signal to input 40 is (−9 +δ)db. Combining these two components in the same manner as used just previously, the power output 46 is equal to ⅛ × (antilog δ +1/antilog δ) It will be readily seen that this sum likewise always has an approximate value of 2 for δ ≤ 0.5. Consequently, output 46 of coupler 38 also reflects 1/4 of the input power which is the desired balanced power level. Deriving the four-way divided output power from the two outputs 44 and 46 of coupler 38 and the two balanced outputs 30 and 32 of couplers 12 and 14, respectively, rather than from the four outputs 30–36 of couplers 12 and 14 provides four equally balanced outputs over the operating frequency range which permits the full capacity of the driven equipment to be realized. Thus, unlike the prior art triple coupler, four-way divider which requires derating the driven equipment by more than 20% in order to avoid overloading any one of the like individual signal processing components such as an amplifying transistor in a four transistor amplifier, the full capacity of all four transistors may be realized, thereby maximizing design economy.

What is claimed is:

1. A four-way power divider employing 3db, 90° couplers, comprising:

a first coupler, having one input connected for receiving the signal whose power is to be divided and the other input connected to a terminatng impedance;

a second coupler, having one input connected to the 0° degree output of said first coupler and the other input connected to a terminating impedance;

a third coupler, having one input connected to the −90° degree output of said first coupler and the other input connected to a terminating impedance, and a fourth coupler, having one input connected to the 0° degree output of said second coupler and the other input connected to the −90 ° degree output of said third coupler, with its two outputs and the −90° and 0° outputs of said second and third couplers, respectively, providing the four-way divided output power.

2. The divider of claim 1 wherein said terminating impedances are resistors whose resistance equals the system characteristic impedance.

3. In combination with a triple 3dB, 90° coupler, four-way power divider, comprising a first coupler having one input connected for receiving the signal whose power is to be divided and the other input connected to a terminating impedance, a second coupler having one input connected to the 0° output of the first coupler and the other input connected to a terminating impedance and a third coupler having one input connected to the −90° output of the first coupler and the other input connected to a terminating impedance, means for providing four balanced power outputs, comprising a fourth 3dB, 90° coupler having one input connected to the 0° output of the second coupler and the other input connected to the −90° output of the third coupler with its two outputs and the −90° and 0° outputs of the second and third couplers, respectively, providing the four-way divided output power.

* * * * *